US007784675B2

(12) United States Patent
Sutherland et al.

(10) Patent No.: US 7,784,675 B2
(45) Date of Patent: Aug. 31, 2010

(54) CARTON HAVING DISPENSING CONFIGURATIONS

(75) Inventors: Robert L. Sutherland, Kennesaw, GA (US); Charles F. Ho Fung, Woodstock, GA (US); Barry D. Biddle, Marietta, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 121 days.

(21) Appl. No.: 11/767,959

(22) Filed: Jun. 25, 2007

(65) Prior Publication Data

US 2007/0295796 A1 Dec. 27, 2007

Related U.S. Application Data

(60) Provisional application No. 60/816,106, filed on Jun. 23, 2006.

(51) Int. Cl.
*B65D 17/28* (2006.01)

(52) U.S. Cl. ..... 229/240; 206/427; 229/120.09; 229/242

(58) Field of Classification Search ..... 229/120.09, 229/120.011, 235, 240, 242; 206/427
See application file for complete search history.

(56) References Cited

U.S. PATENT DOCUMENTS

| | | | | |
|---|---|---|---|---|
| 1,656,919 | A | | 1/1928 | Marsh |
| 1,901,483 | A | | 3/1933 | Ware, Jr. |
| 1,925,102 | A | | 9/1933 | Levkoff |
| 2,027,079 | A | | 1/1936 | Weiss |
| 2,141,743 | A | | 12/1938 | Ethridge |
| 2,145,430 | A | | 1/1939 | New |
| 2,152,079 | A | | 3/1939 | Mott |
| 3,002,613 | A | | 10/1961 | Merkel |
| 3,139,979 | A | * | 7/1964 | Russell ..... 229/120.09 |
| 3,215,332 | A | * | 11/1965 | Bess ..... 229/240 |
| 3,263,900 | A | * | 8/1966 | Link et al. ..... 229/240 |
| 3,276,665 | A | | 10/1966 | Rasmussen |
| 3,280,968 | A | | 10/1966 | Craine |
| 3,653,495 | A | | 4/1972 | Gray |
| 3,759,378 | A | | 9/1973 | Werth |
| 3,786,914 | A | | 1/1974 | Beutler |
| 3,884,438 | A | | 5/1975 | Ross |
| 4,008,849 | A | | 2/1977 | Baber |
| 4,113,100 | A | | 9/1978 | Soja |
| 4,519,538 | A | | 5/1985 | Omichi |
| 4,558,785 | A | | 12/1985 | Gordon |
| 4,742,917 | A | | 5/1988 | Bornwasser |

(Continued)

FOREIGN PATENT DOCUMENTS

| | | |
|---|---|---|
| DE | 2 320 190 | 11/1973 |

(Continued)

OTHER PUBLICATIONS

International Search Report—PCT/US2007/072006.

(Continued)

*Primary Examiner*—Gary E Elkins
(74) *Attorney, Agent, or Firm*—Womble Carlyle Sandridge & Rice, PLLC

(57) ABSTRACT

A carton can be placed in a dispensing configuration by separating the carton into dispenser sections. The dispenser sections may be connected by a hinge that allows the sections to stand side-by-side.

11 Claims, 5 Drawing Sheets

U.S. PATENT DOCUMENTS

| | | | | |
|---|---|---|---|---|
| 4,773,541 | A | 9/1988 | Riddell | |
| 4,793,487 | A * | 12/1988 | Bentsen et al. | 229/120.09 |
| 4,815,609 | A | 3/1989 | Kiedaisch | |
| 4,886,160 | A | 12/1989 | Kligerman | |
| 5,181,650 | A | 1/1993 | Hollander et al. | |
| 5,368,194 | A | 11/1994 | Oliff et al. | |
| 5,699,957 | A | 12/1997 | Blin et al. | |
| 5,722,583 | A | 3/1998 | Focke et al. | |
| 5,788,117 | A | 8/1998 | Zimmanck | |
| 5,842,576 | A | 12/1998 | Snow | |
| 5,857,570 | A | 1/1999 | Brown | |
| 5,878,947 | A | 3/1999 | Hoy et al. | |
| 5,881,884 | A | 3/1999 | Podosek | |
| 5,921,398 | A | 7/1999 | Carroll | |
| 5,927,498 | A | 7/1999 | Saam | |
| 5,979,749 | A | 11/1999 | Bozich | |
| D431,462 | S | 10/2000 | Menaged et al. | |
| 6,129,211 | A | 10/2000 | Prakken et al. | |
| 6,135,289 | A | 10/2000 | Miller | |
| 6,419,152 | B1 | 7/2002 | Tokarski | |
| 6,435,351 | B1 | 8/2002 | Gibb | |
| 6,478,159 | B1 | 11/2002 | Taylor | |
| 6,510,982 | B2 | 1/2003 | White | |
| 6,523,692 | B2 | 2/2003 | Gregory | |
| 6,913,189 | B2 | 7/2005 | Oliff et al. | |
| 6,923,365 | B2 | 8/2005 | Auclair et al. | |
| 7,021,468 | B2 | 4/2006 | Cargile | |
| 7,225,930 | B2 * | 6/2007 | Ford et al. | 229/120.09 |
| 7,328,834 | B2 | 2/2008 | Harrelson | |
| 2001/0001447 | A1 | 5/2001 | Gregory | |
| 2002/0043554 | A1 | 4/2002 | White | |
| 2002/0170845 | A1 | 11/2002 | Oliff | |
| 2004/0099570 | A1 | 5/2004 | Cargile | |
| 2005/0092649 | A1 | 5/2005 | Ford et al. | |
| 2005/0199690 | A1 | 9/2005 | Peterson | |
| 2006/0243739 | A1 | 11/2006 | Sherman et al. | |
| 2006/0266815 | A1 * | 11/2006 | Coltri-Johnson et al. | 229/242 |
| 2007/0000934 | A1 | 1/2007 | Wolpow | |

FOREIGN PATENT DOCUMENTS

| | | | |
|---|---|---|---|
| EP | 0 704 386 | A1 | 4/1996 |
| FR | 1.379.931 | | 12/1963 |
| GB | 1 218 016 | | 1/1971 |
| WO | WO 98/31593 | | 7/1998 |
| WO | WO 03/082686 | A1 | 10/2003 |
| WO | WO 2004/063031 | A1 | 7/2004 |

OTHER PUBLICATIONS

Written Opinion—PCT/US2007/072006.

Preliminary Amendment dated Mar. 4, 2008 for related U.S. Appl. No. 11/767,871.

Office Action mailed Nov. 12, 2008 for related U.S. Appl. No. 11/767,871.

Amendment mailed Feb. 3, 2009 for related U.S. Appl. No. 11/767,871.

Final Office Action mailed May 13, 2009 for related U.S. Appl. No. 11/767,871.

Amendment mailed Aug. 13, 2009 for related U.S. Appl. No. 11/767,871.

Office Action mailed Oct. 14, 2009 for related U.S. Appl. No. 11/767,871.

* cited by examiner

CARTON HAVING DISPENSING CONFIGURATIONS

PRIORITY APPLICATION

This application claims the benefit of U.S. Provisional Application No. 60/816,106, filed Jun. 23, 2006, which is hereby incorporated by reference in its entirety.

RELATED APPLICATION

This application is related to U.S. Provisional Application No. 60/815,967, filed Jun. 23, 2006.

BACKGROUND

Enclosed cartons with dispensing features have been used in the past. Many such cartons include article dispensers defined by lines of disruption such as tear lines, cuts, score lines, and fold lines. A dispenser may be removable from a carton to create an opening from which articles can be removed from the carton. In some cartons, however, the dispenser may not provide sufficient access to all of the containers within the carton, which may render it difficult to remove all of the containers from the carton.

SUMMARY

The present invention generally relates to a carton accommodating a plurality of articles arranged in the carton in at least two rows and at least two columns. The carton can include a tear feature that allows the carton to be placed in a dispensing configuration. In the dispensing configuration, the carton is separated into a first section and a second section, with each section accommodating a portion of the articles. The carton can include a hinge connecting the two sections and about which the carton is pivoted to place the carton in the dispensing configuration.

According to another aspect of the invention, recessed or open portions can be formed at upper edges of the first and second sections as the carton is placed in the dispensing configuration. The recessed portions, which can be defined in one or more side panels of the first and second sections, allow for ease of access to, and dispensing of articles from, the first and second sections. In one embodiment, the carton can be placed in the dispensing configuration by removing a tear strip extending around three sides of the carton to separate the carton into the first and second sections, and pivoting the first and second sections about a hinge in a fourth side of the carton so that the first and second sections are in a side-by-side configuration.

According to yet another aspect of the invention, the first and second sections may be completely separated from one another to place the carton in a dispensing configuration.

Other aspects, features, and details of the present invention can be more completely understood by reference to the following detailed description of exemplary embodiments taken in conjunction with the drawings and from the appended claims.

BRIEF DESCRIPTION OF THE DRAWING FIGURES

According to common practice, the various features of the drawings discussed below are not necessarily drawn to scale. Dimensions of various features and elements in the drawings may be expanded or reduced to more clearly illustrate the embodiments of the invention.

DETAILED DESCRIPTION

The present invention generally relates to cartons capable of being placed in a dispensing configuration by separating the carton into sections. The present invention can be used, for example, in cartons that contain articles or other products such as, for example, food and beverages. The articles can also include beverage containers such as, for example, cans, bottles, PET containers, or other containers such as those used in packaging foodstuffs. For the purposes of illustration and not for the purpose of limiting the scope of the present invention, the following detailed description describes generally cylindrical, 12-ounce beverage containers as disposed within the illustrated carton embodiments.

To facilitate understanding and explanation of the blank of the present invention, the elements and numerals described herein utilize the terms "end" and "side" to distinguish portions of the carton and of the blank. These conventions are included merely for ease of explanation and understanding of the present description, however, and should not be limiting in any manner. The descriptions of the panels as "end" and "side" etc., also can be referred to as "first," "second," etc. The terms "end" and "side" are not intended to connote relative size differences between elements.

Figure 1:
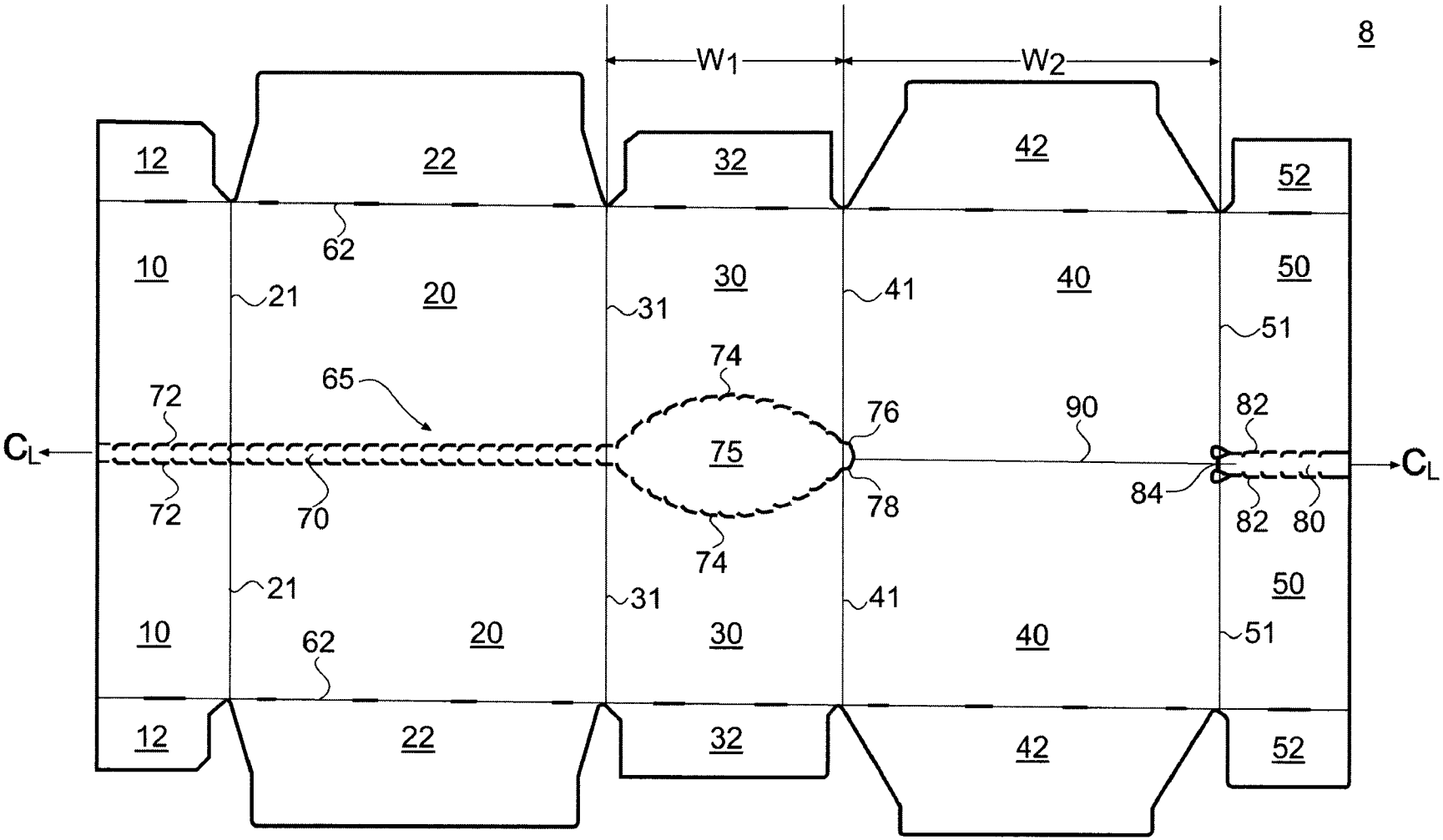
FIG. 1 is a plan view of a blank from which a carton according to a first embodiment of the invention is formed.

FIG. 1 is a plan view of the exterior or print side of a blank 8 that can be used to form a carton 150 (illustrated in FIG. 2) according to a first embodiment of the invention. As shown in FIG. 1, the blank 8 may be symmetric or nearly symmetric about a longitudinal center line $C_L$. Therefore, certain elements in the drawing figures are indicated by like or similar reference numerals in order to reflect the longitudinal symmetry. The blank 8 comprises a pair of first side panels 10, each side panel 10 being foldably connected to a second side panel 20 at a first transverse fold line 21, a pair of third side panels 30, each third side panel 30 being foldably connected to a second side panel 20 at a second transverse fold line 31, a pair of fourth side panels 40, each fourth side panel 40 being foldably connected to a third side panel 30 at a third transverse fold line 41, and a pair of fifth side panels 50, each fifth side panel 50 being foldably connected to a fourth side panel 40 at a fourth transverse fold line 51.

Each first side panel 10 is foldably connected at one end to a first end flap 12. Each second side panel 20 is foldably connected at one end to a second end flap 22. Each third side panel 30 is foldably connected at one end to a third end flap 32. Each fourth side panel 40 is foldably connected at one end to a fourth end flap 42. Each fifth side panel 50 is foldably connected at one end to a fifth end flap 52. The end flaps 12, 22, 32, 42, 52 may be arranged along marginal areas of the blank 8, and may be foldably connected along longitudinally extending fold lines 62. The longitudinally extending fold lines 62 may be straight or substantially straight fold lines, or may be offset at one or more locations to account for, for example, blank thickness. When the carton 150 is erected from the blank 8, the end flaps 12, 22, 32, 42, 52 close each end of the carton 150.

According to one aspect of the first embodiment, the blank 8 includes a tear pattern 65 of lines of disruption that bifurcate the blank and allow the erected carton 150 (FIG. 2) constructed from the blank 8 to be placed in a dispensing configuration. The tear pattern 65 includes a first tear feature 70 that separates the pair of side panels 10, 20 and extends adjacent to and continuous with a second tear feature 75 that separates the pairs of side panels 30. The first tear feature 70 can be, for example, a tear strip defined by spaced breachable lines of disruption 72, which may be tear lines. The second tear feature 75 can be defined by opposed, curved or arched breachable lines of disruption 74, which may be tear lines. The opposed tear lines 74 can extend to a point adjacent to one another, or can be connected by cuts or scores 76, 78, which can extend, as shown in FIG. 1, into side panels 40 or, alternatively but not shown, terminate in the side panels 30 or at the transverse fold line 41. A longitudinal hinge or pivot line 90 separates (e.g., defined a boundary between) the side panels 40 and extends adjacent to a third tear feature 80 that separates the side panels 50. The third tear feature 80 can be, for example, a tear strip defined by spaced breachable lines of disruption 82, which may be tear lines. A tear tab 84 can be provided at the end of the third tear feature 80.

The tear lines 72, 74, 82 can be breachable lines of disruption formed from continuous or substantially continuous tear lines comprised of, for example, tear lines, scores, creases, cuts, gaps, cut/creases, perforations, offset cuts, and overlapping and/or sequential combinations thereof. If cuts are used to form the tear lines 72, 74, 82, the cuts may be, for example, interrupted by breachable nicks. The breachable lines of disruption 76, 78 may be continuous cuts, cuts interrupted by breachable nicks, or other forms of breachable lines of disruption, such as scores. The hinge line 90 can be, for example, any line of disruption between the panels 40 that facilitates hinged folding or pivoting of the blank 8.

Still referring to FIG. 1, the dimensions of the blank 8 may be selected to accommodate characteristic dimensions of articles to be accommodated within the carton 150. For example, in one embodiment, the side panels 30 can have a width $W_1$ that generally corresponds to or slightly exceeds a height $H_C$ of containers C (illustrated in FIG. 5) or other articles to be accommodated within the carton 150. When cylindrical or substantially cylindrical containers C are used in the carton, the side panels 40 (as well as the side panels 20) can have, for example, a width $W_2$ that generally corresponds to or slightly exceeds an integral multiple of a largest (e.g., "characteristic") diameter $D_C$ (FIG. 5) of the containers C. The length $L_1$ of the side panels 40 can generally correspond to or slightly exceed an integral multiple of the characteristic diameter $D_C$. If multiple generally cylindrical containers C, such as, for example, metallic beverage containers, are to be accommodated within the carton 150, it may be expected that the generally cylindrical containers will share at least one substantially equal common largest diameter.

An exemplary method of erection of the carton 150 is discussed below with reference to FIGS. 1 and 2.

Referring to FIG. 1, the carton 150 may be erected from the blank 8 by folding the blank flat at each of the transverse fold lines 21, 41 so that the undersides of the fifth side panels 50 can be glued or otherwise adhered to upper sides of corresponding adjacent first side panels 10, or so that the undersides of the first side panels 10 can be glued or otherwise adhered to upper sides of the fifth side panels 50. Each end flap 52 may be adhered to an adjacent end flap 12. The distal end of the third tear feature 80 is adhered to the distal end of the first tear feature 70 so that they may act in unison. The side panels 10, 20, 30, 40, 50 may then be opened to a generally tubular or sleeve form.

Each end of the generally tubular sleeve form may be closed, for example, by folding the end flaps 32 and the adhered end flaps 12, 52 inwardly across the open ends, followed by inwardly folding the end flaps 42, then folding the end flaps 22 inwardly. At each end of the tubular sleeve form, the interior side of each end flap 42 can be adhered to the end flaps 12, 32, 52, and the interior side of each end flap 22 can be adhered to one or more of the end flaps 12, 32, 52, 42. Substantially cylindrical containers C or other articles, for example, may be loaded into the tubular sleeve in a conventional manner at any time before one or both ends of the carton are closed by the end flaps 12, 22, 32, 42, 52. In the exemplary embodiment, the carton 150 accommodates twelve containers C in three rows and four columns.

Figure 2:
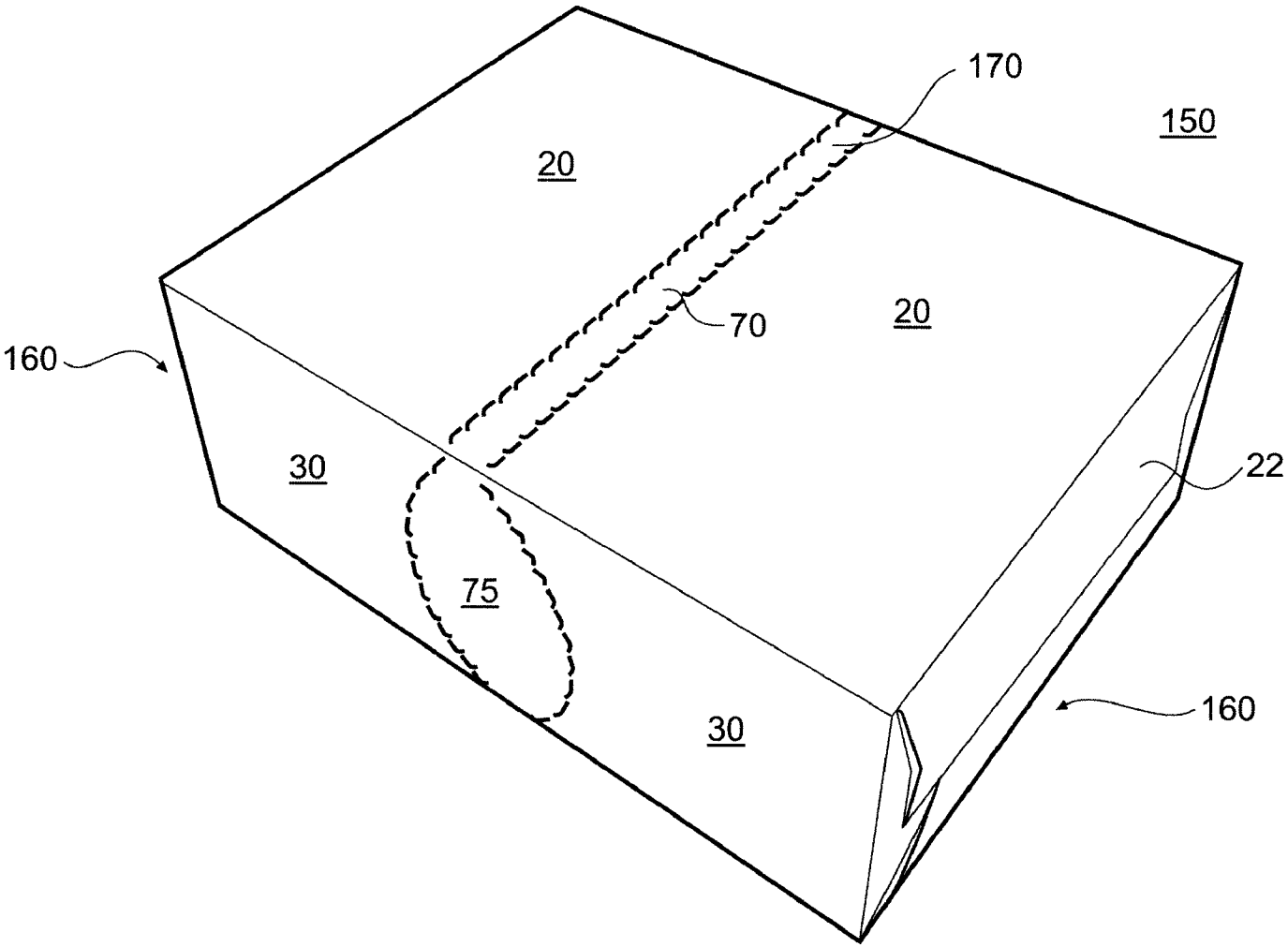
FIG. 2 illustrates the first carton embodiment.

FIG. 2 is a perspective view of the carton 150 erected from the blank 8 illustrated in FIG. 1. In the erected carton 150, the end flaps 12, 22, 32, 42, 52 form an end panel 160 at each end of the carton 150. With the ends closed, the carton 150 has a substantially parallelepipedal shape. The sequentially arranged tear features 70, 75, 80 illustrated in FIG. 1 extend partially around the perimeter of the carton 150 (e.g., around three side of the carton) and define a variable cross-section or width tear strip 170 in the erected carton 150.

Figure 3:
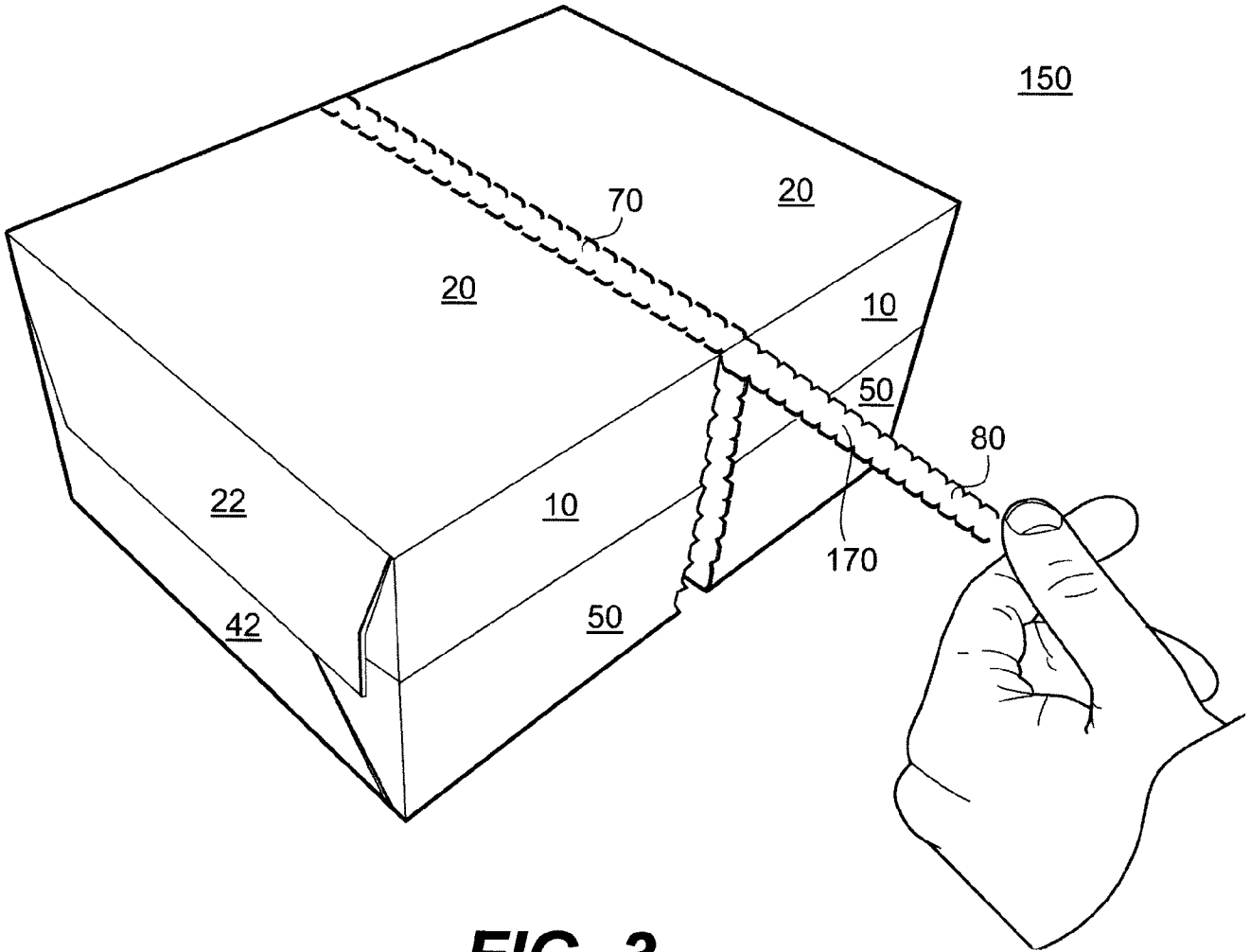
FIGS. 3-4 illustrate placing the first carton embodiment into a dispensing configuration.
Figure 4:
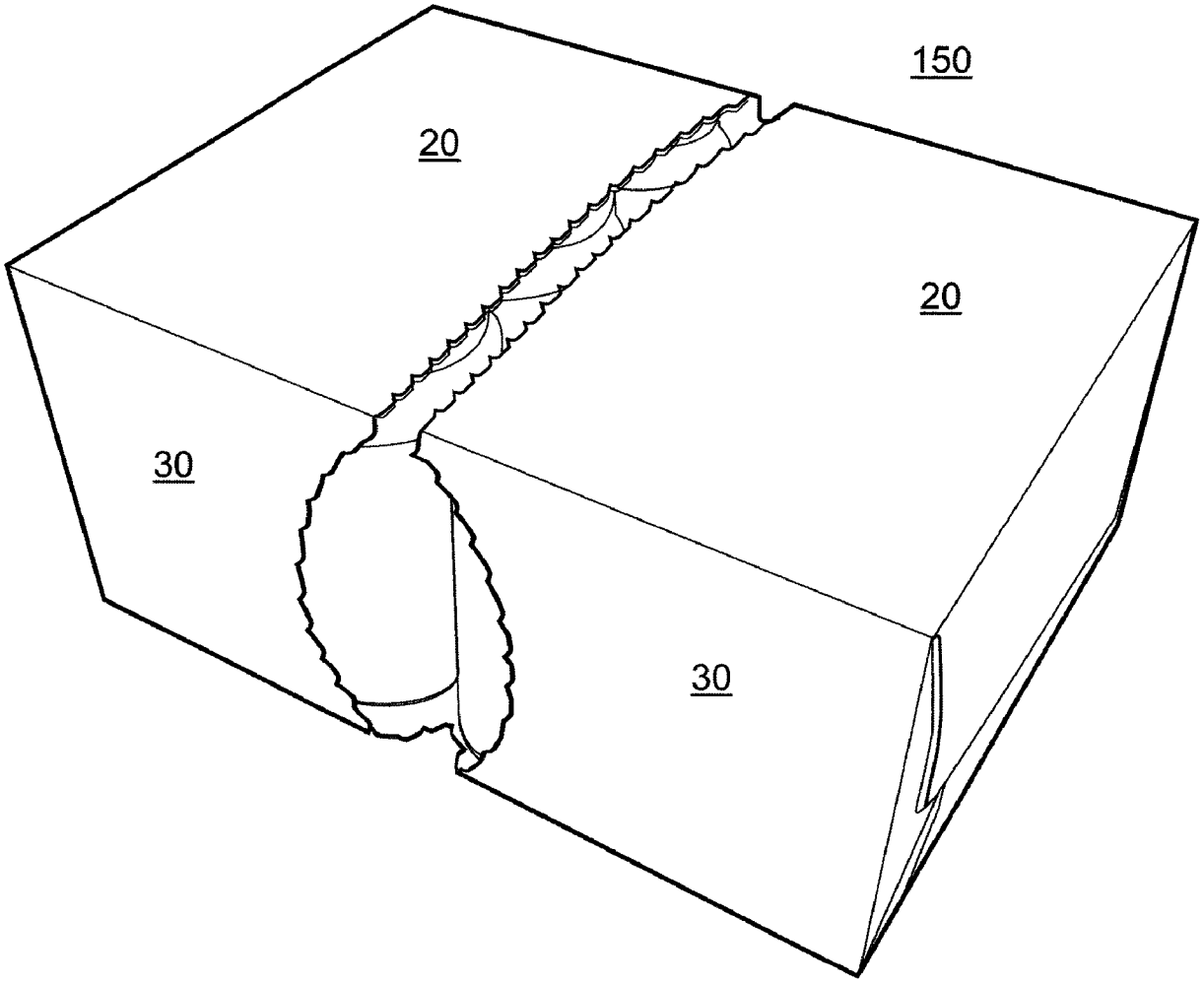
Figure 5:
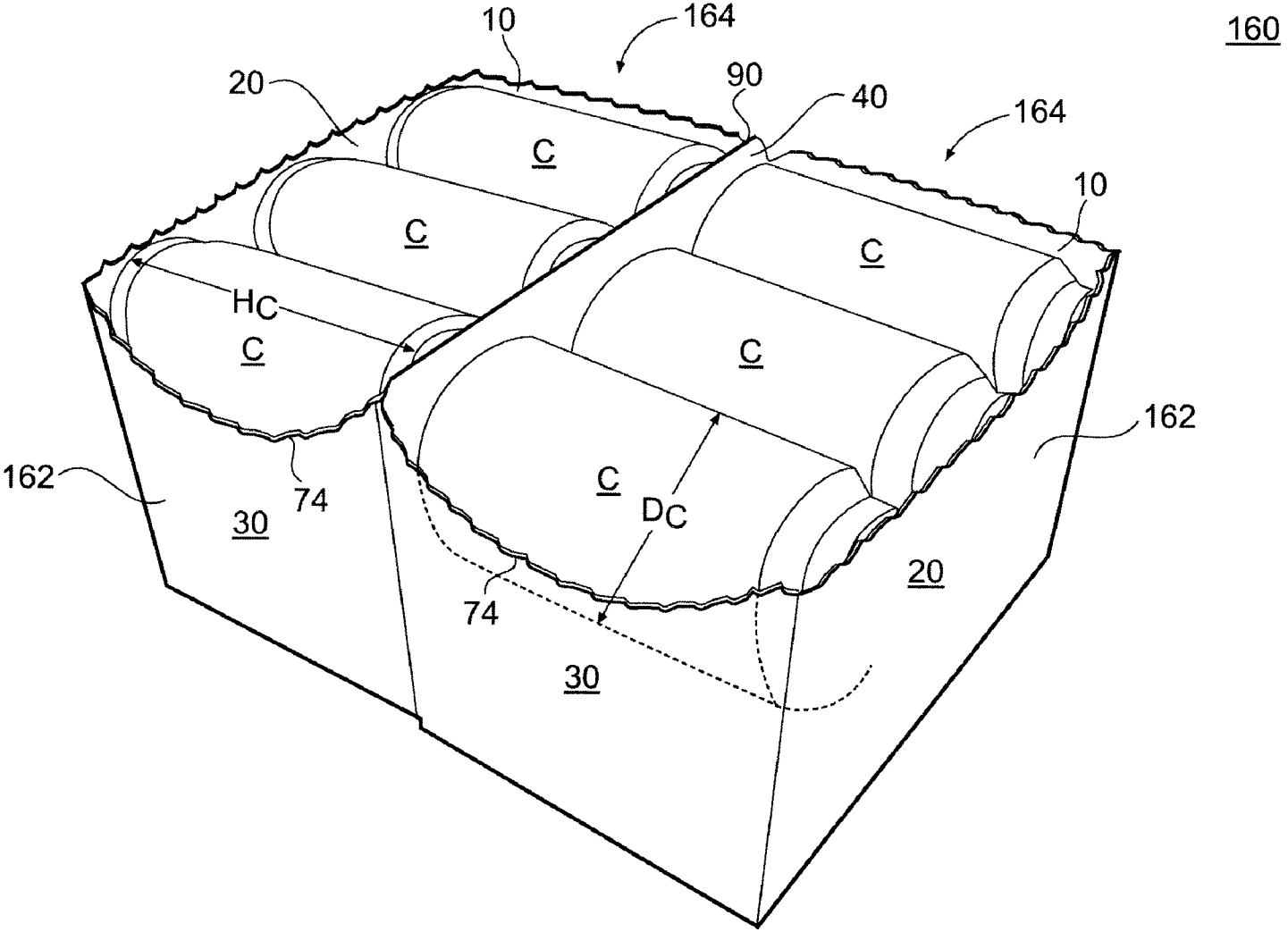
FIG. 5 illustrates the first carton embodiment in the dispensing configuration.

FIGS. 3-5 illustrate an exemplary method of placing the carton 150 into a dispensing configuration using the tear strip 170 and the exemplary method is discussed below.

Referring to FIG. 3, the tear strip 170 is grasped at the tear tab 84 and pulled so that the third tear feature 80 is torn along the tear lines 82, separating the side panels 50. The third tear feature 80 is adhered to the first tear feature 70 so that the tearing motion causes the first tear feature 70 to tear along the tear lines 72, separating the side panels 10. Referring to FIG. 4 and also to FIG. 1, the first tear feature 70 is further torn to separate the side panels 20, and the second tear feature 75 is torn so that the tear strip 170 may be removed from the carton 150 to separate the side panels 30.

Referring to FIG. 5, the carton is folded or pivoted about the hinge line 90 so that the side panels 40 are adjacent to one another. The carton is now in a dispensing configuration comprising a pair of hingedly connected side-by-side dispenser sections 162 having dispenser openings 164 at a top end of each section, and is designated by the reference numeral 160.

In the dispensing configuration, each dispenser section 162 of the carton 150 accommodates six generally cylindrical containers C, arranged in three rows and two columns. In FIG. 5, the containers C are lying on their curved side surfaces, with longitudinal axes of the containers C being parallel to or aligned with a support surface of the sections 162, and aligned with the plane of the end panels 160 (FIG. 2). The longitudinal axes of the containers C, which pass through the tops and bottoms of the containers C, are transverse to the hinge line 90. The containers C are accessible through the dispenser openings 164. In the illustrated embodiment, the dispenser sections 162 are identical or substantially identical. Variations may be introduced, however, to one or both of the sections 162 so that they are not identical. For example, the perimeter edge of the dispenser opening 164 of one or both of the sections 162 could be varied by changing the shape of one or more of the tear features 70, 75, 80. Also, dispenser features could be introduced in one or both of the sections 162 below the dispenser openings 164.

The curved tear lines 74 defining the variable width second tear feature 75 form recessed open sections, or reliefs, in the side panels 30, at the upper edges defined by the tear lines 74. The open or recessed sections in the side panels 30 allow for ease of accessing and/or dispensing containers C through the dispenser openings 164. Additional recessed or open portions can, for example, be provided along the top edge of the sections 162, such as at the top edge of one or more of the side panels 10 or 20. Recessed portions of the top edges of the side panels 10 and/or 20 can be created, for example, by varying the cross section of the tear strip 70 (FIG. 3). Open cutout portions can also be created by incorporating removable sections, such as knockout sections (not shown), in the side panels.

In the illustrated embodiment, the dispenser sections 162 are hingedly connected while in the dispensing configuration, wherein the carton 150 is torn along three sides while a fourth side of the carton including the hinge line 90 remains intact. In an alternative embodiment, the first and second sections 162 may be separated from one another along the hinge line 90 (e.g., by replacing the hinge line with a breachable line of disruption) so that the carton is separated along four sides of the carton 150 in order to place the carton in a dispensing configuration.

EXAMPLE 1

A parallelepipedal carton 150 as illustrated in FIG. 2 accommodates twelve, 12 fluid ounce, cylindrical containers C in a 3×4×1 arrangement. The width $W_1$ is about 4⅞ in., and the width $W_2$ is about 7¾ in. The length $L_1$ is about 5⅛ in. In the dispensing configuration, each dispenser section 162 (FIG. 5) accommodates six containers C in a 3×2×1 arrangement.

In the above embodiments, the exemplary carton is described as accommodating twelve, 12-ounce, generally cylindrical beverage containers C in a 3×4×1 configuration. Other arrangements of containers, packages, articles, and other items, however, can be accommodated within a carton constructed according to the principles of the present invention. For example, a carton constructed according to the principles of the present invention would also function satisfactorily if the carton were sized and shaped to hold articles in other configurations, such as 3×2×1, 3×6×1, 2×4×1, 2×6×1, 2×8×1, 4×2×1, 4×4×1, 4×6×1, etc., and multi-tier variations of the aforementioned configurations.

The dimensions of the exemplary blank may be altered, for example, to accommodate various container forms. For example, 16-ounce or 20-ounce petaloid bottle containers, or other beverage bottle containers, such as plastic bottles having longitudinal axes, may be accommodated within cartons constructed according to the principles of the present invention. In such arrangements, the first or bottom ends of the bottles could be adjacent to the second or fourth side panel pairs.

In accordance with the exemplary embodiments, the blank may be constructed of paperboard. The blank can also be constructed of other materials, such as cardboard, hard paper, solid unbleached sulfate (SUS) board, or any other material having properties suitable for enabling the carton to function as described above. The blank can also be laminated to one or more sheet-like materials at selected panels or panel sections.

The interior and/or exterior sides of the blank can be coated with a clay coating. The clay coating may then be printed over with product, advertising, price coding, and other information or images. The blank may then be coated with a varnish to protect any information printed on the blank. The blank may also be coated with, for example, a moisture barrier layer, on either or both sides of the blank.

For purposes of the description presented herein, the term "line of disruption" can be used to generally refer to cut lines, tear lines, crease lines, score lines, and fold lines (or overlapping and/or sequential combinations of at least one cut line, crease line, score line, tear line, or fold line). A "breachable line of disruption" is a line of disruption that is intended to be breached during ordinary use of the carton, such as when placing the carton in a dispensing configuration. An example of a breachable line of disruption is a tear line.

In accordance with the above-described embodiments of the present invention, a fold line can be any substantially linear, although not necessarily straight, line of disruption or other form of weakening that facilitates folding therealong. More specifically, but not for the purpose of narrowing the scope of the present invention, fold lines include: score lines; cuts that extend partially into a material along the desired line of weakness, and/or a series of cuts that extend partially into and/or completely through the material along the desired line of weakness; and various overlapping and/or sequential combinations of these features.

In the present specification, a "panel" or "flap" need not be flat or otherwise planar. A "panel" or "flap" can, for example, comprise a plurality of interconnected generally flat or planar blank sections.

Although each side panel is shown with a corresponding end flap, the side panels could alternatively not all include end flaps and a blank could be provided with enough end flaps only to close each end of the carton.

The above embodiments may be described as having one or more panels adhered together by glue during erection of the carton embodiment. The term "glue" is intended to encompass all types of adhesives commonly used to secure carton panels in place.

It will be understood by those skilled in the art that while the present invention has been discussed above with reference to exemplary embodiments, various additions, modifications and changes can be made thereto without departing from the spirit and scope of the invention as set forth in the following claims.

What is claimed is:

1. A method of dispensing generally cylindrical containers from a carton, comprising:

obtaining a substantially parallelepipedal carton formed from a blank comprising a first side panel, a second side panel foldably connected to the first side panel, a third side panel foldably connected to the second side panel, a fourth side panel foldably connected to the third side panel, and a fifth side panel foldably connected to the fourth side panel, a first plurality of end flaps foldably connected along a first marginal area of the blank, a second plurality of end flaps foldably connected along a second marginal area of the blank, a tear pattern extending in at least the first, second, third, and fifth side panels, and a hinge extending in at least the fourth side panel, the tear pattern comprising a first tear feature in the third side panel and a second tear feature in the fifth side panel and the hinge extending from respective ends of the first and second tear features, the carton having four sides formed from the first, second, third, fourth, and fifth side panels, a first end comprised of the first plurality of end flaps, and a second end comprised of the second plurality of end flaps, the first tear feature is an enlarged tear feature, wherein at least a portion of the enlarged tear feature is wider than the remainder of the tear pattern;

obtaining a plurality of generally cylindrical containers accommodated in the carton in at least two rows and at least two columns, each generally cylindrical container having a longitudinal axis, a container side, a first container end and a second container end;

separating the carton at least three of the sides into a first dispenser section and a second dispenser section so that the two dispenser sections remain hingedly attached in side-by-side configuration, wherein the first dispenser section accommodates a first plurality of the plurality of generally cylindrical containers and has a first open top through which the first plurality of containers can be dispensed, the first open top being at a top end of the first dispenser section opposite to the first end of the carton, the second dispenser section accommodates a second plurality of the plurality of generally cylindrical containers and has a second open top through which the second plurality of containers can be dispensed, the second open top being at a second top end of the second dispenser section opposite to the second end of the carton, substantially all of the containers in a bottom column of the first plurality of containers rest on their sides on the first end of the carton, and substantially all of the containers in a bottom column of the second plurality of containers rest on their sides on the second end of the carton; and removing at least one of the first plurality of generally cylindrical beverage containers from the first dispenser section.

2. The method of claim 1, wherein separating the carton into the dispenser sections comprises tearing the tear pattern along the three sides of the carton.

3. The method of claim 1, wherein the number of containers in the first plurality of containers is equal to the number of containers in the second plurality of containers.

4. The method of claim 1, wherein the plurality of containers comprises at least eight containers arranged in at least two rows and at least four columns.

5. The method of claim 1, wherein the first plurality of containers comprises at least six containers arranged in at least three rows and at least two columns.

6. The method of claim 1, further comprising:

pivoting the dispenser sections about the hinge connecting the first and second dispenser sections to place the first and second dispenser sections in a side-by-side configuration.

7. The method of claim 6, wherein the hinge extends across one of the four sides, dividing the side into a first portion and a second portion, and wherein said pivoting step places the first portion in face-to-face contact with the second portion.

8. The method of claim 1, the enlarged tear feature being shaped differently than a remainder of the tear pattern.

9. The method of claim 8, the enlarged tear feature being defined by curved tear lines and the remainder of the tear pattern being defined by generally straight tear lines.

10. The method of claim 1, the tear pattern further comprising a third tear feature extending in at least the first and second side panels.

11. The method of claim 1, the tear pattern comprising a tear strip.

* * * * *